US007228867B2

(12) United States Patent
Goodwin et al.

(10) Patent No.: US 7,228,867 B2
(45) Date of Patent: Jun. 12, 2007

(54) TENT POLE BRACKETS AND METHODS OF USE

(75) Inventors: Dianne M. Goodwin, St. Paul, MN (US); Sherry M. Rovig, Duluth, MN (US); Kevin B. Kinney, Duluth, MN (US)

(73) Assignee: Blue Sky Designs, Inc., Minneapolis, MN (US)

( * ) Notice: Subject to any disclaimer, the term of this patent is extended or adjusted under 35 U.S.C. 154(b) by 285 days.

(21) Appl. No.: 10/913,072

(22) Filed: Aug. 6, 2004

(65) Prior Publication Data

US 2006/0027256 A1 Feb. 9, 2006

(51) Int. Cl.
*E04H 15/62* (2006.01)
*E04H 15/32* (2006.01)

(52) U.S. Cl. ..... 135/118; 135/120.4; 135/119; 135/907; 248/508; 248/530

(58) Field of Classification Search ..... 135/118–119, 135/120.4, 116, 137, 907; 248/507–508, 248/520, 530, 534, 538; 211/202; 114/294
See application file for complete search history.

(56) References Cited

U.S. PATENT DOCUMENTS 3,058,480 A * 10/1962 Blanchard ..... 135/97
4,007,902 A * 2/1977 Pettee ..... 248/534
4,257,181 A * 3/1981 Cooper ..... 43/21.2
D279,026 S * 5/1985 Nordgren et al. ..... D21/775
4,782,846 A 11/1988 Ting
5,269,488 A * 12/1993 Lach ..... 248/535
5,333,634 A * 8/1994 Taylor ..... 135/98
5,404,896 A * 4/1995 Howe ..... 135/125
5,615,699 A 4/1997 Lee
5,628,336 A 5/1997 Lee
5,771,912 A 6/1998 Swetish
5,897,514 A * 4/1999 Currier ..... 602/16
5,901,726 A 5/1999 Gal et al.
5,954,077 A 9/1999 Wain et al.
6,269,825 B1 * 8/2001 Yager ..... 135/120.1
6,418,952 B1 7/2002 Worley et al.
6,575,184 B2 6/2003 Kozak
2002/0073601 A1 * 6/2002 DeSorcy ..... 43/25

FOREIGN PATENT DOCUMENTS

JP 2002-188324 * 7/2002

* cited by examiner

*Primary Examiner*—Winnie Yip
(74) *Attorney, Agent, or Firm*—Crompton, Seager & Tufte LLC

(57) ABSTRACT

A tent pole bracket for use with a tent having a pole, which may comprise a body having a first end and a second end and a first side and a second side, the body including a wall defining an elongate cavity for receiving a tent pole, the cavity being open on the first end and open on the first side, and the body having a slot for receiving a strap, and methods of use thereof.

11 Claims, 10 Drawing Sheets

TENT POLE BRACKETS AND METHODS OF USE

FIELD OF THE INVENTION

The present invention relates generally to components for erecting tents, particularly recreational tents such as camping tents, rain flies, dining flies or canopies, and particularly to components for attaching poles or other structural elements to tents.

BACKGROUND OF THE INVENTION

Most modern tents are self-supporting structures where the tent fabric and poles are used together to form a structure that does not need to be attached to the ground to stand. This is typically done by attaching poles to the walls or sides of tents, often through clips or fabric sleeves and by attaching the pole ends to the bottom or floor of the tent.

While other designs exist, the substantial majority of tents use one of the following two methods to attach pole ends to tents: rivets or pins. In the grommet method, a strap extending from the tent fabric has a grommet fixed to it or a pocket sewn in it. The tent pole end, typically tapering or having a stepwise reduction in diameter, is passed through the grommet or into the pocket. In the second common method, pins are usually attached to the tent bottom. Tent poles having hollow ends (tent poles are often hollow throughout) are placed over the pins and the pins are inserted in the ends. In both methods, the force from the tent poles being bent or pushed against taut tent fabric is used to keep the tent pole ends in place.

While these methods of fastening tent poles are popular, they share certain disadvantages. Both methods require a high level of strength and dexterity. Tent poles, often as less than three-eights inch in diameter, are often made of plastic or metal and give little traction. The tent poles and the tent fabric need to be forced into a state of high strain to permit enough room between the tent pole end and the fastener to use the fastening method. A narrow tent pole needs to be forced onto a still smaller pin or into a small pocket or rivet while the tent pole is being held in a state of high strain. This can be difficult for anyone and may be well impossible for one who has insufficient strength or dexterity. Millions of older or disabled people may be prevented from erecting a tent because the design of the most modern tents is too difficult to erect.

There is thus a need for a fastening means which requires a lower level of strength and dexterity to operate.

SUMMARY OF THE INVENTION

One example embodiment pertains to a tent bracket which has an elongate generally upright cavity open on one end and on one connecting side. The tent bracket may include a slot for receiving a strap of a tent or other mechanism for affixing the tent bracket to the tent. The tent bracket is configured to rotate away from the tent to receive an end of a tent pole in the cavity and then to rotate towards the tent to secure the tent pole in the cavity. The tent bracket may include a flexible clip to retain the tent pole in the bracket and may include a flange on a top portion of the tent bracket. The wall of the cavity may be curved, for example, or may be another suitable shape and may include one or more ribs to provide strength or to guide the tent pole end to the bottom of the cavity. The slot may have one opening on a first wall facing the tent and angle down to another opening on the bottom surface of the tent bracket.

Another example embodiment pertains to a use for a tent bracket such as that described above. The tent bracket may be rotated towards the tent and slid onto a strap affixed to the tent. The tent bracket may be then rotated to angle away from the tent, and the end of a tent pole may be inserted into the cavity through the side opening. The tent bracket may then be rotated back towards the tent to an upright position. As the tent bracket is rotated to an upright position, the end of the tent pole is forced towards the bottom of the cavity. The tent pole may then be clipped in place in the cavity and the strap may be staked to the ground.

The above summary of some embodiments is not intended to describe each disclosed embodiment or every implementation of the present invention. The figures, and detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings in which.

Figure 1:
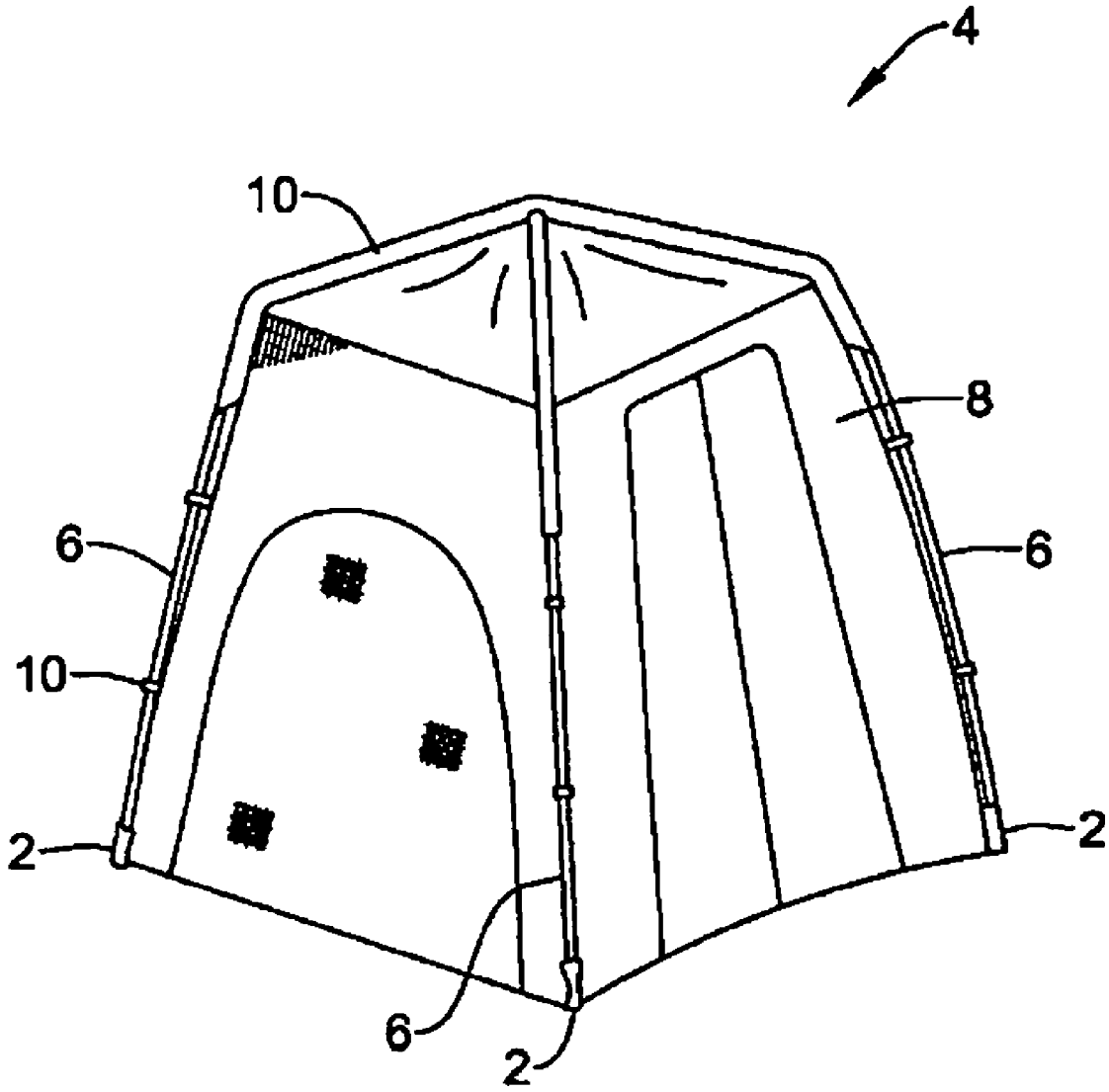
FIG. 1 is a perspective view showing an example embodiment, tent bracket 2, in use on a tent 4.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE INVENTION

Reference is now made to the figures, in which like element numbers refer to like elements throughout.

FIG. 1 is a perspective view showing an example embodiment, a tent bracket 2, in use on a tent 4. Tent bracket 2 is holding the end of a tent pole 6 fixed relative to tent 4. Tent 4 includes tent wall 8 and pole fasteners 10 attaching the tent wall to tent poles 6. Tent poles may be slidably or fixedly attached to tent wall 8. Pole fasteners 10 are depicted as sleeves attached to the tent through which tent poles are threaded and as clips attached to the tent that clip to the tent poles. However, any suitable method of attaching the tent wall to the poles may be used. For example, string ties may be used to fasten the tent wall to the tent poles, or sleeves or clips may be used exclusive of each other. Tent wall 8 may be made from any flexible wall material. Nylon and canvas are example but not limiting materials suitable for tent wall 8. Tent wall 8 may include any desired features such as doors, screen, or windows. Tent 4 is depicted as a four-sided tent having a frame made from two crossing tent poles, but tent bracket 2 is suitable for use with a wide variety of tents, such as done tents, cabin tents, A-frame tents, or other tents having any number of poles. Tent bracket 2 may also be suitable for use with other tent structures such as dining flies, canopies, and vestibules. Tent poles 6 may be any tent poles suitable for use with the tent design. For example, the tent poles may be solid or hollow, they may be of one-piece or of segmented construction, and they may be made of aluminum, fiberglass, or other suitable materials.

Figure 2:
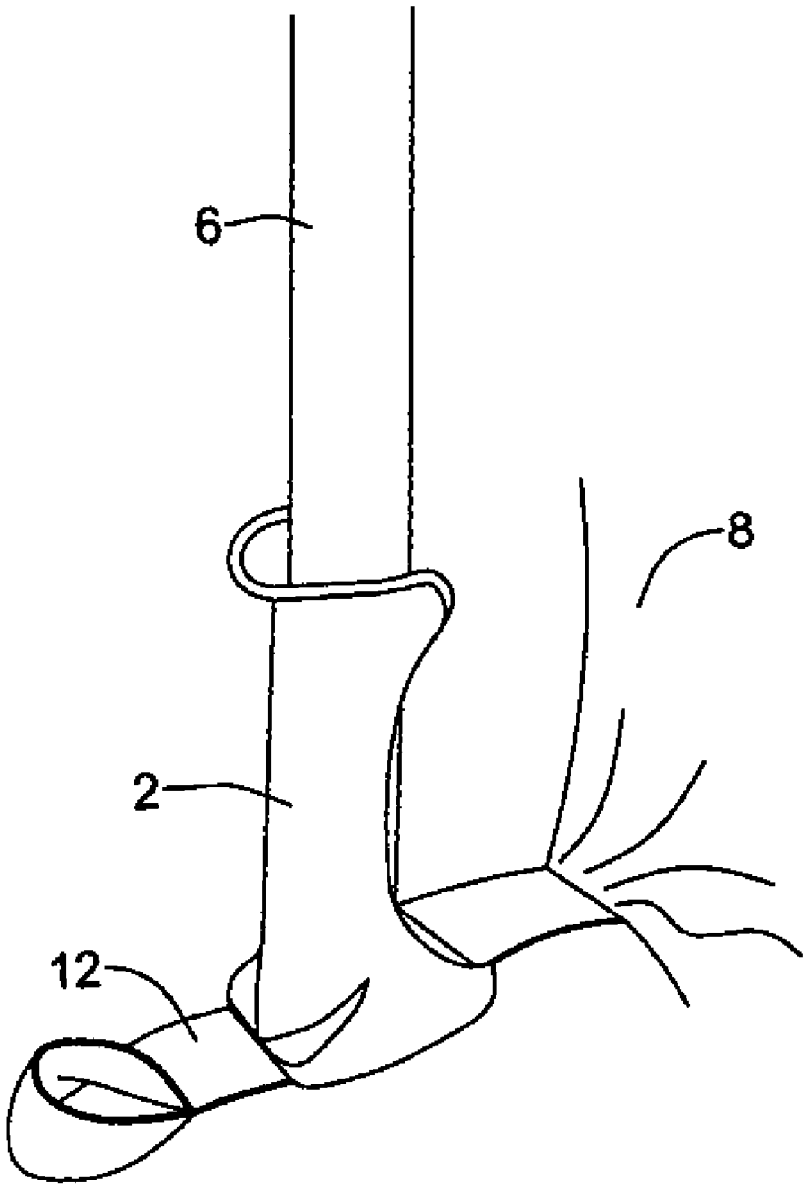
FIG. 2 is a fragmentary perspective view showing tent bracket 2 in use on tent 4.

FIG. 2 is a fragmentary perspective view of a tent bracket 2 in use on a tent 4. Tent 4 includes a strap 12, which passes through tent bracket 2. An end portion of tent pole 6 is disposed in tent bracket 2. As will be described in detail below, tent bracket 2 is a separate item which may be removed from tent 4. However, in certain contemplated embodiments, a tent bracket according to an embodiment of the invention may be a fixed part of the tent. A tent bracket may be fixedly attached directly to tent wall 8 or may be fixedly attached through the use of a strap such as strap 12.

Figure 3A:
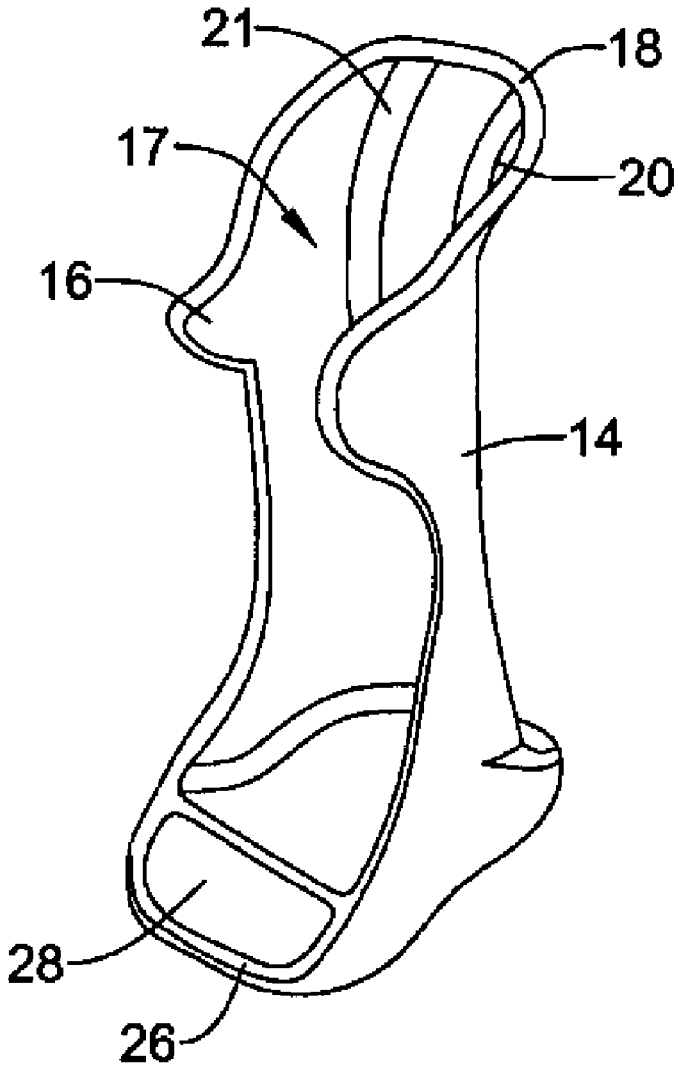
FIG. 3A is a perspective view showing tent bracket 2 from one angle.
Figure 3B:
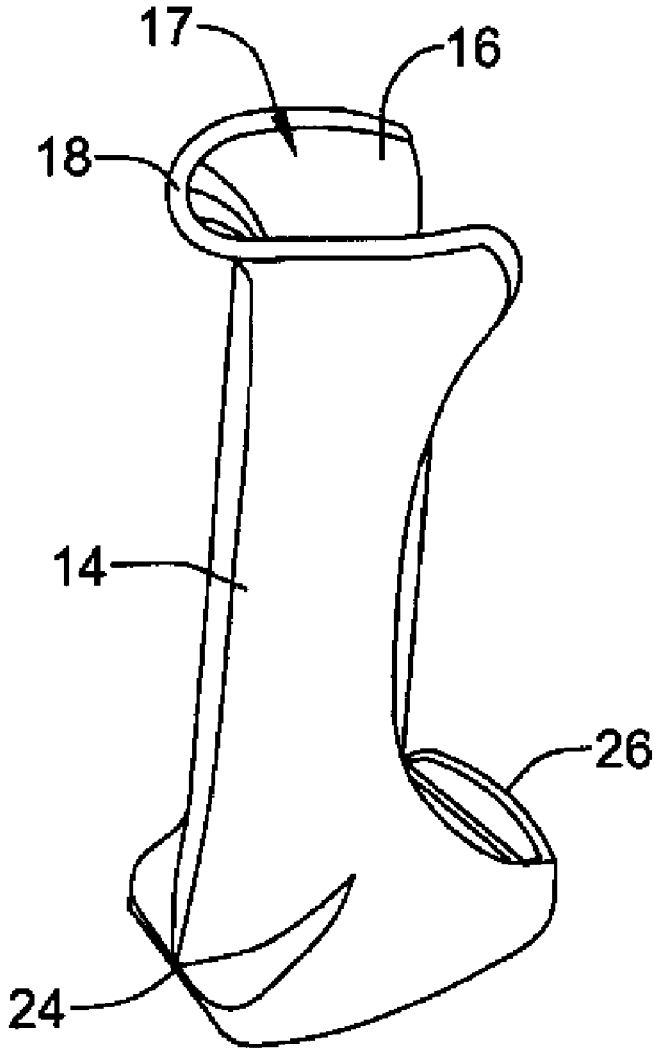
FIG. 3B is a perspective view showing tent bracket 2 from an opposite angle.

FIG. 3A is a perspective view showing tent bracket 2 from one angle and FIG. 3B is a perspective view showing tent bracket 2 from a second angle. Tent bracket 2 include a wall 14 defining a cavity 17. Cavity 17 is generally open on a first end and on a first side, as can be best seen in FIG. 3A. Cavity 17 is generally dimensioned to have sufficient width to easily admit a tent pole yet be confining enough to provide enough support to the tent pole. The cavity openings on the first end and on the first side may form a single lumen. This lumen should be wide enough to admit into the cavity a portion of a tent pole.

A pair of ears forming a clip 16 may extend from the wall near the first end. The clip is configured to allow a tent pole to pass through, temporarily deflecting the clips, and then to retain the tent pole in the cavity. Other retaining mechanisms or none may be used. For example, a Velcro™ strap may be secured to the wall and used to secure a tent pole in the cavity.

A flange 18 may extend from the first end of the wall and curves away from the cavity. This flange may be used to help guide the tent pole into the cavity, or it may be used to provide a spot to grip when removing the tent pole from the cavity. The flange may be omitted or may alternately extend perpendicular to the wall away from the cavity. In some contemplated embodiments, a handle, such as a looped handle, is attached to the wall rather than or in addition to the flange. In other contemplated embodiments, a groove, clips or other mechanism for easily attaching a handle or an extension to the wall of the tent bracket may be included.

One or more ribs 20 may run along wall 14 on the cavity side, to facilitate the sliding of the tent pole along the wall or to provide support to the wall of the tent bracket or guidance to the tent pole, as will be described later. The ribs may provide strength and may optionally be located on the outside of the wall. The wall is shown as having a curved lateral cross-section defining a substantial area of the cavity. The wall may have other lateral cross-sections as well. For example, the wall may have an angled lateral cross-section such as a half-square or half-hexagon lateral cross-section. The wall may be any suitable shape. The wall is shown having a generally straight profile in the direction between the first end and a second end opposite the first end. In certain contemplated embodiments, the wall may have other profiles in this direction. For example, the wall may have a convex or a concave profile.

Figure 4:
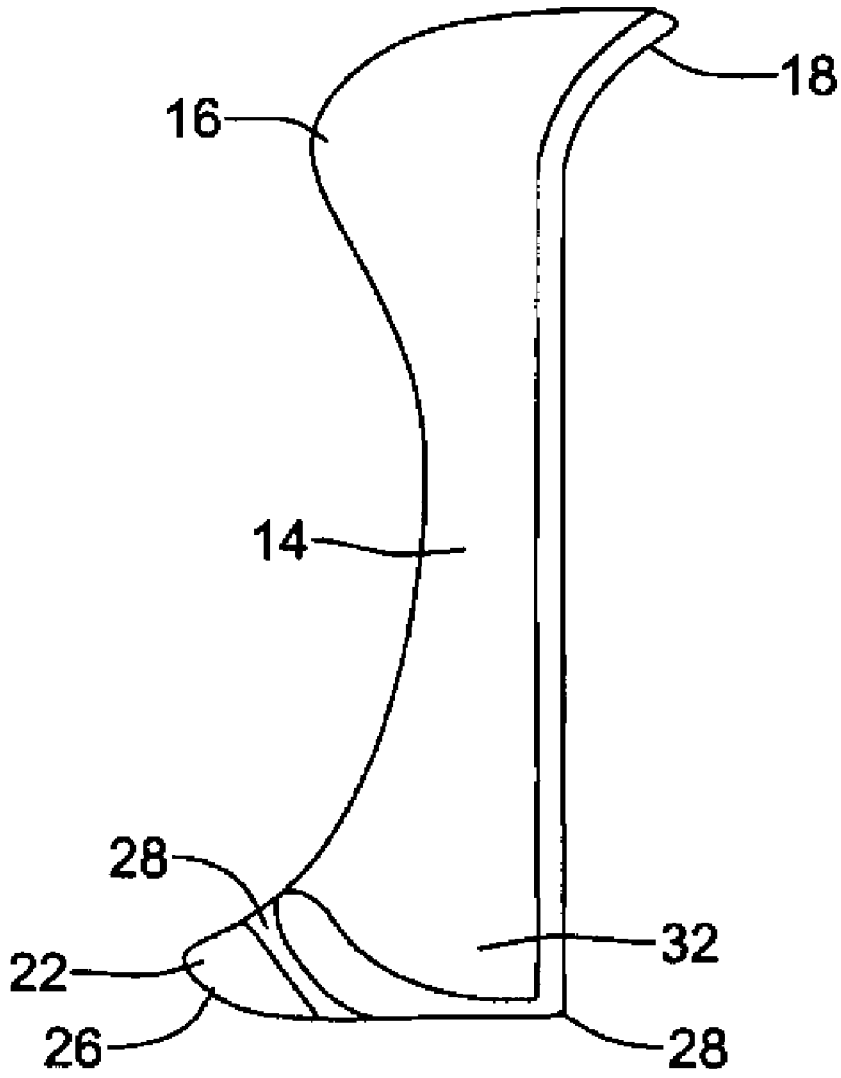
FIG. 4 is a cross-sectional view showing tent bracket 2.

At the second end of the wall is a foot 22. Foot 22 may include a slot 28 for receiving a tent strap 12. As can be seen in FIG. 4, which is a cross-sectional representation of tent bracket 2, the slot may extend from the first side of the tent bracket to the bottom of the foot. The tent bracket may be slidable along a strap received in the slot when the tent bracket is rotated towards the tent, and may be fixed when the tent bracket is in a more upright position or rotated away from the tent. The strap may pass through the slot and under the portion of the foot under the cavity. Thus, the force of the tent pole in the cavity may help secure the bracket to the strap.

Of course, other configurations are contemplated. For example, the slot can extend from the first side to the second side opposite the first side. The slot may include a hinged clip to lock the strap in place. In certain embodiments, the tent bracket may be permanently affixed to the strap. If the tent uses means other than straps, ropes for example, the slot may be adapted to receive the ropes and fixedly hold the tent bracket thereto. The tent bracket may be adapted to clip directly onto the wall of the tent, The tent bracket may include a ratchet or other mechanism suitable for advancing or forcing the tent bracket along the strap.

In another contemplated embodiment a loop formed of a strap is attached to the foot at the first side. The loop is attached to the tent, thus permanently attaching the foot to the tent. Another strap extends through the slot and exits under the foot. This strap may have a loop at its end for thrusting a tent stake through.

The foot may also include a recess 32, which may confine a tent pole end on the front, back, sides, and bottom. In this embodiment, the recess has a front which is at an obtuse angle to the bottom. This may ease the removal of the tent pole from the tent bracket.

The foot is depicted in FIG. 4 as having a gently curved bottom surface. Embodiments are contemplated where the bottom surface has a different shape, such as flat. The foot may have a straight back edge 24 and a straight front edge 26. These edges may provide pivot axes when the tent bracket is rocket backward and forward as shown below. The foot may be longer or broader than the tent pole bottom end to provide for additional stability.

The tent bracket may be made from any suitably strong and rigid material or any suitable combination thereof. For example, the tent bracket may be made from a polymer such as nylon, polyvinylchloride, or polycarbonate. The tent bracket may be made from a metal or metal alloy such as aluminum or stainless steel. The tent bracket may be made from a composite material such as fiberglass or carbon fiber.

Figure 5:
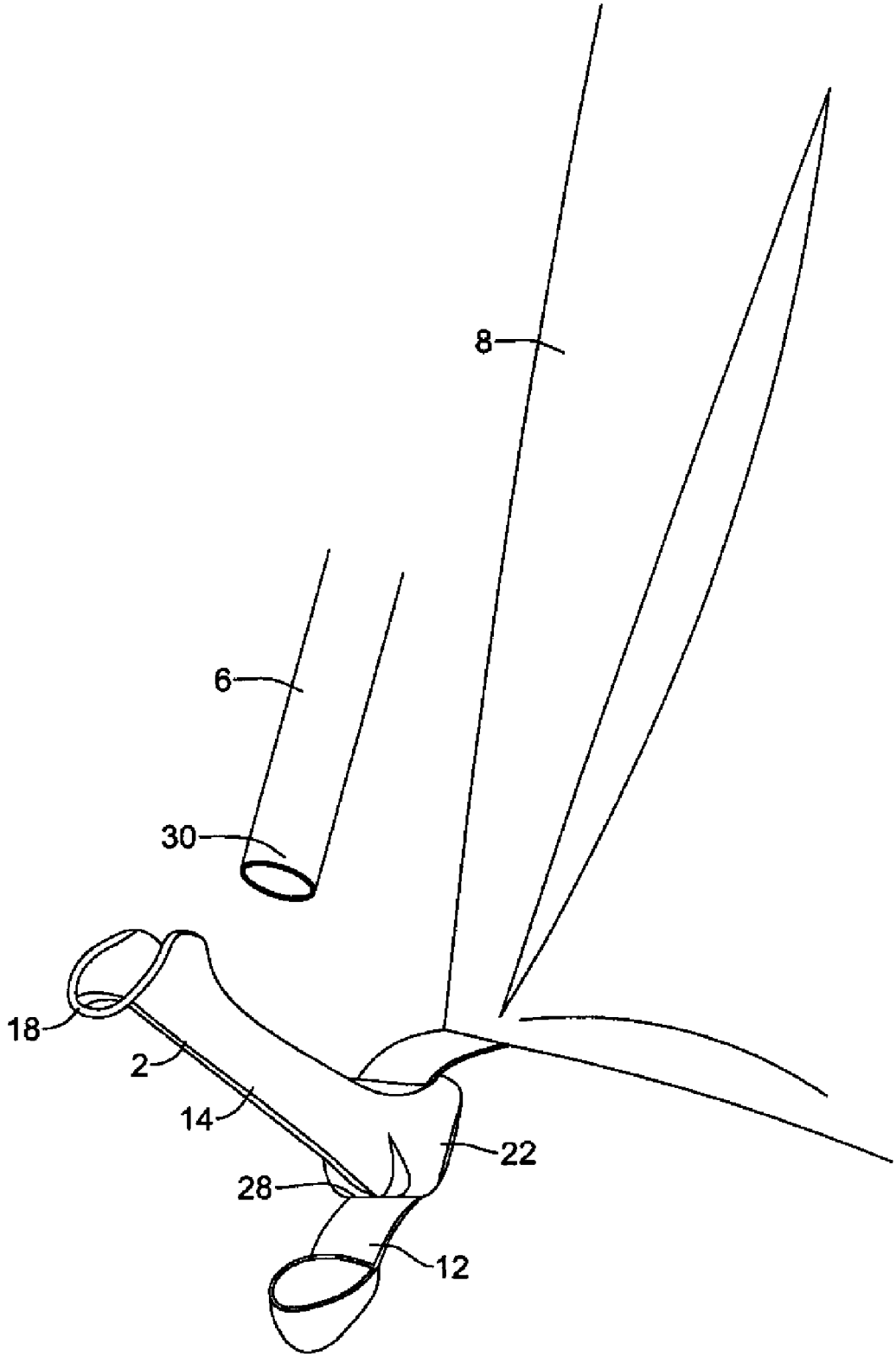
FIG. 5 is a fragmentary perspective view showing tent bracket 2 in use.

In one contemplated use, the tent bracket 2 may be slid along a strap 12 to a desired location, such as shown in FIG. 5, which is a fragmentary perspective view. The tent bracket may then be pivoted away from the tent about the rear edge of the bracket. A tent pole 6, which may have been previously attached to the tent though clips, sleeves or other mechanisms, is moved to place the end 30 of the pole through the lumen and into the cavity.

Figure 6A:
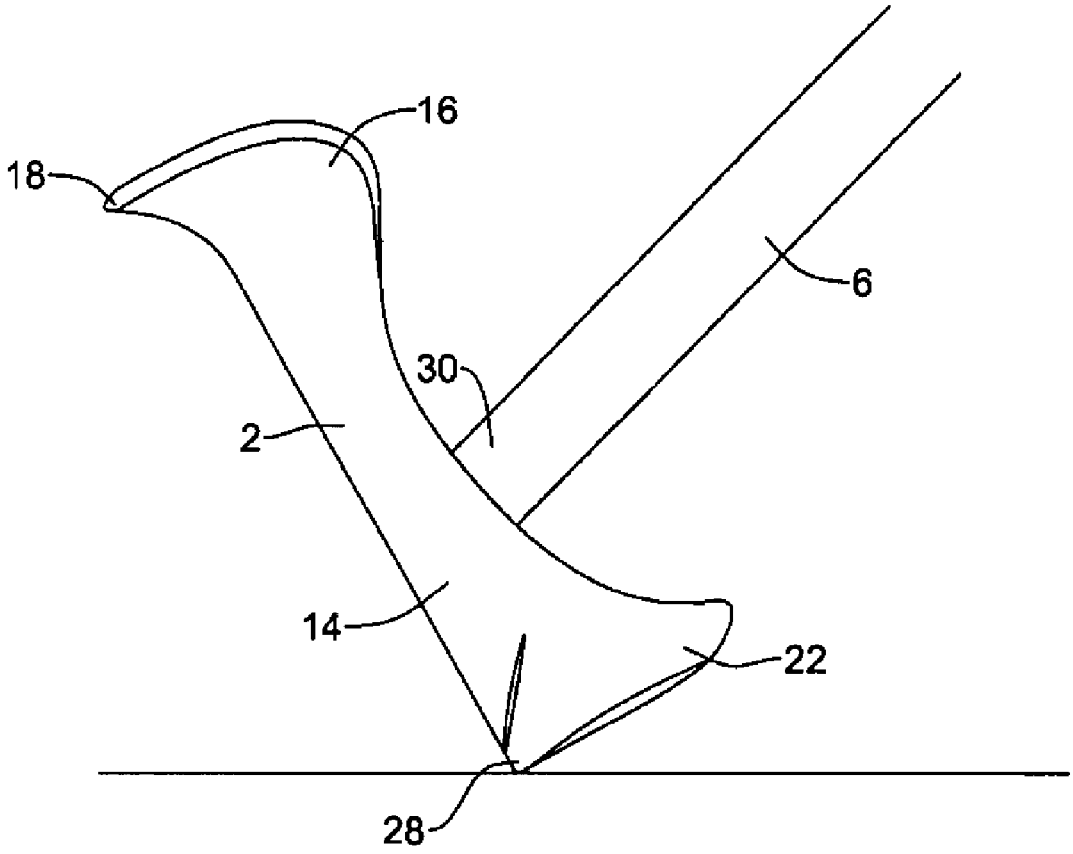
FIG. 6A is a fragmentary side view showing tent bracket 2.
Figure 6B:
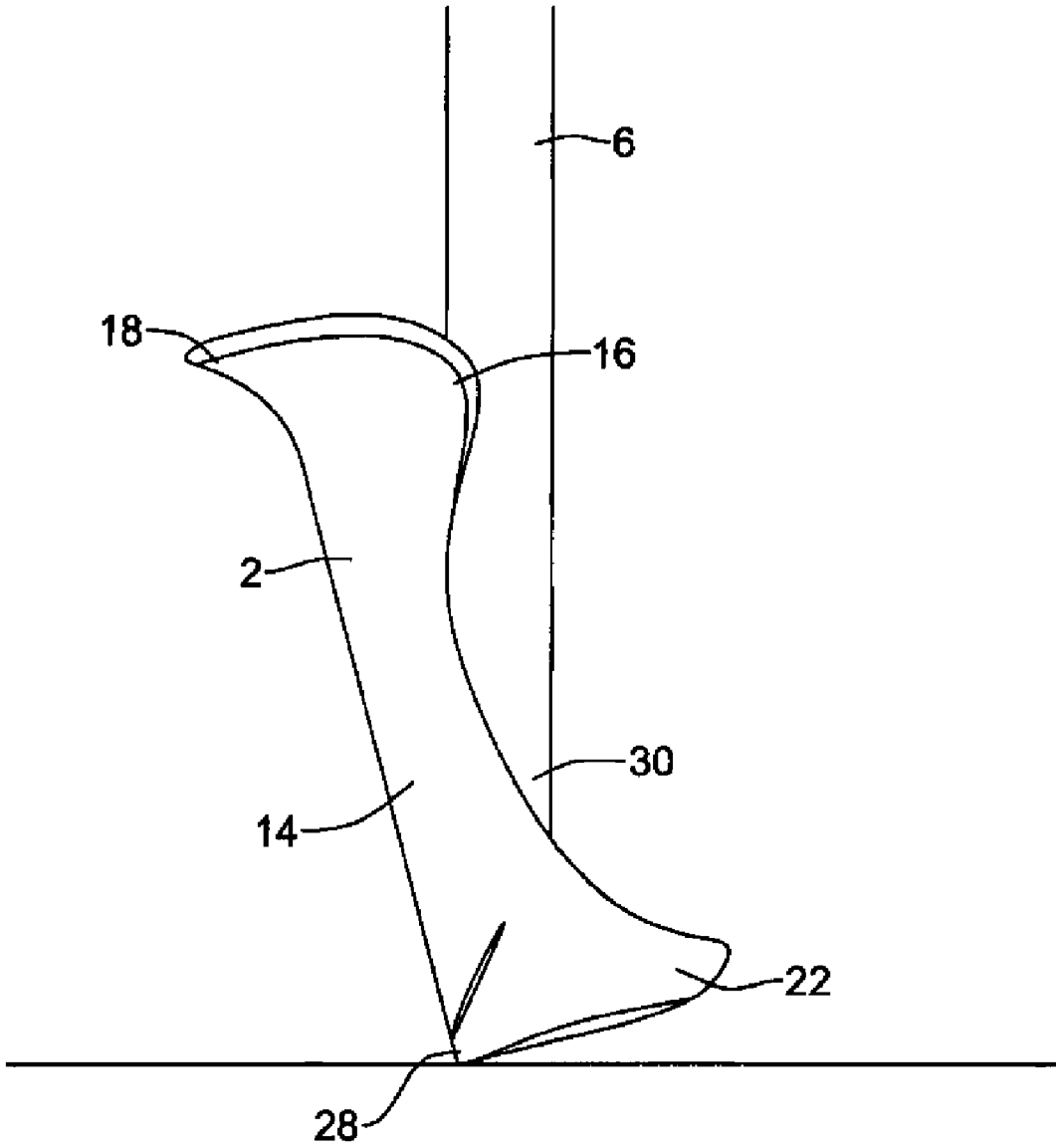
FIG. 6B is a fragmentary side view showing tent bracket 2.
Figure 6C:
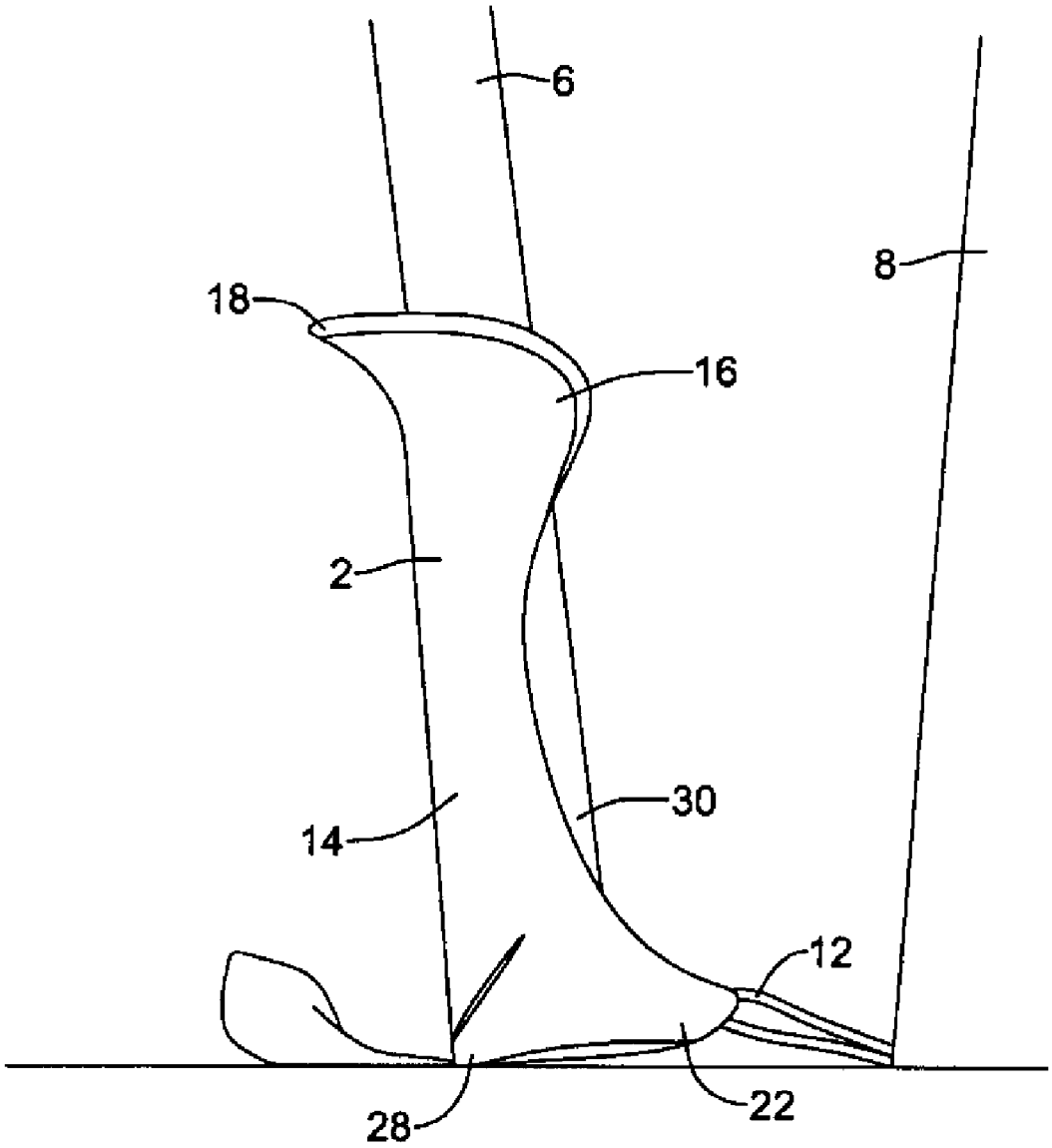
FIG. 6C is a fragmentary side view showing tent bracket 2.
Figure 7:
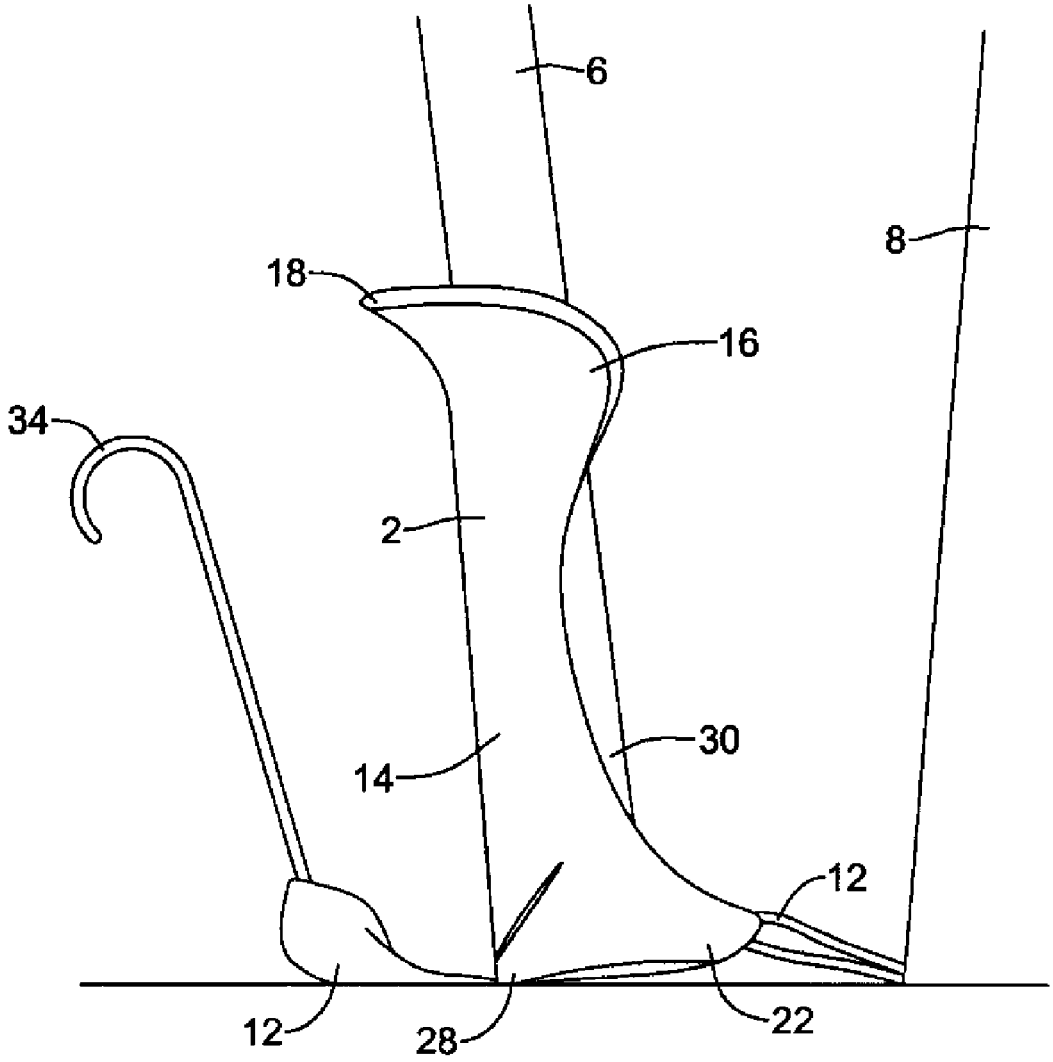
FIG. 7 is a fragmentary side view showing tent bracket 2.

Once the tent pole is in the cavity 17 of the tent bracket, the tent bracket is pivoted about the rear edge towards the tent. FIGS. 6A, 6B, and 6C are side views showing tent bracket 2 and tent pole 6. As the tent bracket is pivoted towards the tent, the end 30 of the tent pole drops into the bottom of the cavity 17 and into recess 32. As the pivoting process continues, the tent pole is forced pass clip 16 and is secured in the cavity 17, as shown in FIG. 6C. Strap 12 may then be secured to the ground with a tent stake 34, if desired, as shown in FIG. 7.

In this contemplated use, to remove the tent pole from the tent bracket is also a simple process. If a stake had been used, it may be pulled and removed. The tent bracket may then be rotated away from the tent. To do this it may be necessary to pull on flange 18, which extends away from the tent pole and so provides a place to grip. The tent bracket may then be rotated away from the tent until the wall is against the ground. The tent pole may then be free from the bracket or may be easily removed from the bracket. The bracket can then be rotated towards the tent until it is angled towards the tent and then slid off from the strap.

Numerous advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The inventions's scope is, of course, defined in the language in which the appended claims are expressed.

What is claimed is:

1. A tent structure, comprising a tent pole bracket having a wall defining an elongate cavity for receiving a tent pole, the cavity having an opening in a first end extending into a first side and having a bottom surface opposite the opening in the first end, and having a slot extending through a portion of the bracket;

a strap extending through the slot; and a tent pole having a first end, the tent pole being disposed in the cavity, wherein the bracket has a first position wherein a portion of the tent pole is disposed in the elongate cavity.

2. The tent structure of claim 1, wherein the bracket has a second position where the bracket is rotated about a lateral axis with respect to the bracket in the first position, the tent pole first end being disposed in the bottom of the cavity and a portion of the tent pole near the first end of the tent pole is outside the cavity.

3. The tent structure of claim 2, wherein the bracket and the strap are fixed with respect to each other in the first position and slidable with respect to each other in a third position, the third position having the bracket rotated about the lateral axis in the opposite direction from the second position.

4. The tent structure of claim 3, wherein the bracket and the strap are fixed with respect to each other in the second position.

5. The tent structure of claim 4, wherein a substantial portion of the wall is sized and shaped to confine the tent pole portion on three longitudinal sides.

6. The tent structure of claim 5, wherein the substantial portion of the wall is curved.

7. The tent structure of claim 1, wherein the strap enters the slot on the first side of the bracket and exits the slot on a bottom surface of the bracket.

8. A method of erecting a tent structure, comprising the steps of:

providing a bracket having an elongate cavity having an opening on a first end and on a first side;

providing a tent having a strap extending therefrom;

providing a tent pole having a first end and a portion near the first end;

attaching the bracket to the strap;

disposing the tent pole first end in the cavity; and wherein disposing the tent pole first end in the cavity includes passing the tent pole first end through the opening on the first side.

9. The method of claim 8. further comprising the steps of:

rotating the bracket away from the tent; and rotating the bracket towards the tent, wherein the tent pole portion near the first end is disposed in the cavity during the step of rotating the bracket towards the tent.

10. The method of claim 8, wherein the step of providing a bracket includes the step of providing the bracket having a slot, and wherein the step of attaching the strap to the bracket includes the step of sliding the strap through the slot.

11. The method of claim 8, further comprising the steps of:

disposing the tent on a ground surface;

passing a stake through the strap into the ground surface.

* * * * *